US006022663A

United States Patent [19]

Chen et al.

[11] Patent Number: 6,022,663

[45] **Date of Patent: *Feb. 8, 2000**

[54] METHOD OF FUSING HEAT-SOFTENABLE TONER IMAGES

[75] Inventors: Jiann Hsing Chen, Fairport; Tsang Jan Chen; Ricki Wayne Burger, both of Rochester, all of N.Y.

[73] Assignee: Eastman Kodak Company, Rochester, N.Y.

[ * ] Notice: This patent is subject to a terminal disclaimer.

[21] Appl. No.: 09/105,761

[22] Filed: Jun. 26, 1998

Related U.S. Application Data

[63] Continuation-in-part of application No. 08/681,562, Jul. 29, 1996, abandoned, which is a continuation-in-part of application No. 08/216,200, Mar. 22, 1994, abandoned, which is a continuation-in-part of application No. 07/919,669, Jul. 27, 1992, abandoned.

[51] Int. Cl.[7] ..... G03G 13/20

[52] U.S. Cl. ..... 430/124; 430/99; 428/421; 428/447

[58] Field of Search ..... 430/99.124; 427/194; 118/60; 399/333, 325, 324; 428/447, 909, 421

[56] References Cited

U.S. PATENT DOCUMENTS

| | | | |
|---|---|---|---|
| 4,029,827 | 6/1977 | Imperial et al. | 427/22 |
| 4,101,686 | 7/1978 | Strella et al. | 427/22 |
| 4,185,140 | 1/1980 | Strella et al. | 428/418 |
| 4,257,699 | 3/1981 | Lentz | 355/3 |
| 4,264,181 | 4/1981 | Lentz et al. | 430/99 |
| 4,272,179 | 6/1981 | Seanor | 430/99 |
| 4,372,246 | 2/1983 | Azar et al. | 118/60 |
| 4,711,818 | 12/1987 | Henry | 428/421 |
| 5,141,788 | 8/1992 | Badesha et al. | 428/36.8 |
| 5,401,570 | 3/1995 | Heeks et al. | 428/332 |
| 5,781,840 | 7/1998 | Chen et al. | 399/324 |

OTHER PUBLICATIONS

Xerox Disclosure, vol. 9, No. 1, Jan./Feb., 1984.

*Primary Examiner*—Janis L. Dote

[57] ABSTRACT

A method of fusing a heat-softenable toner image to a substrate in which a release oil is applied to the surface of a fusing member, the fusing member is incubated at an elevated temperature for a time sufficient to bond a protective layer of the release oil to the surface thereof, and the toner image is pressure contacted with the fusing member at a temperature effective to fuse the toner image to the substrate, is characterized in that the surface of the fusing member is comprised of a fluoroelastomer and the release oil is an Si—H functionalized organopolysiloxane. The method provides excellent toner release characteristics and is advantageous in that it utilizes release oils that are free from offensive odor and toxicity.

20 Claims, No Drawings

METHOD OF FUSING HEAT-SOFTENABLE TONER IMAGES

CROSS-REFERENCE TO RELATED APPLICATIONS

This application is a continuation-in-part of U.S. Pat. application Ser. No. 08/681,562, filed Jul. 29, 1996, now abandoned, which is a continuation-in-part of U.S. patent application Ser. No. 08/216,200, filed Mar. 22, 1994, now abandoned, which is a continuation-in-part of U.S. patent application Ser. No. 07/919,669, having the same title and authors, filed Jul. 27, 1992, now abandoned, all applications incorporated herein by reference.

FIELD OF THE INVENTION

This invention relates in general to electrostatographic imaging processes and in particular to the fusing of toner images utilized in such processes. More specifically, this invention relates to an improved method of fusing toner images using a heated fusing member.

BACKGROUND OF THE INVENTION

In certain electrostatographic imaging and recording processes such as electrophotographic copying processes, an electrostatic latent image formed on a photoconductive surface is developed with a thermoplastic toner powder which is thereafter fused to a substrate. The fusing step commonly involves directly contacting the substrate, such as a sheet of paper on which toner powder is distributed in an imagewise pattern, with a heated fusing member such as a fuser roll. In most instances, as the powder image is tackified by heat, part of the image carried by the sheet sticks to the surface of the roll so that as the next sheet is advanced, the tackified image partially removed from the first sheet partly transfers to the next sheet and at the same time part of the tackified image from the next sheet adheres to the heated roll. Any toner remaining adhered to the heated surface can cause a false offset image to appear on the next sheet that contacts the fusing roll and can also degrade the fusing performance of the fusing surface.

To prevent toner offset, many expedients have been tried such as providing the fusing roll with an adhesive surface such as a thin coating of an elastomer, e.g., a fluoroelastomer, or a silicone polymer of low surface energy. Also polymeric release oils, e.g., polydiorganosiloxane release oils such as polydimethylsiloxane release oils have been applied to the fuser roll surface. With such materials, however, problems can occur. One problem is that the fluoro-elastomers and silicone polymers are difficult to wet with polymeric release oils and the application of excessive amounts of such oils to the surfaces of fuser rolls in order to achieve sufficient surface wetting can cause oil stains on the paper to which toner is being fused.

U.S. Pat. Nos. 4,264,181 and 4,272,179 describe fuser rolls having surfaces comprising fluoroelastomers and metal-containing fillers that provide sites that react with functionalized polymeric release agents such as mercapto-functional polydiorganosiloxane release agents to provide a surface adhesive to toner materials and reduce toner offset. Unfortunately, as such fuser rolls wear, fresh active sites that are exposed react not only with the functionalized polymeric release agents but also react with various components of the toner materials and the paper substrate. Such reaction builds up debris on the surface of the fuser roll which results in permanent damage to such surface. This greatly reduces the life of the fuser roll. Additionally, the metal-containing filler particles are physically torn from the fuser surface during use which also reduces the life of the fuser roll. Use of mercapto-functional polydiorgano-siloxane release agents is also undesirable because of concerns relating to toxicity and unpleasant odors.

U.S. Pat. Nos. 4,029,827, 4,101,686 and 4,185,140 also describe the use of functionalized polymeric release agents with heated fusing members.

It is toward the objective of providing an improved method of fusing heat-softenable toner images—using a particular combination of release oil and fusing member surface—that the present invention is directed.

SUMMARY OF THE INVENTION

This invention provides a method of fusing a toner image to a substrate, which comprises:

applying a release oil to the surface of a fusing member, said surface of said fusing member comprise a fluoroelastomer, said release oil comprises an organopolysiloxane having Si—H functional groups, incubating said fusing member at 100° C. to 250° C. in the absence of a dehydrohalogenating agent, to bond a protective layer of said release oil to said surface of said fusing member, said protective layer having a thickness of 0.5 to 40 nanometers, and pressure contacting a toner image and a substrate with said fusing member at a temperature effective to fuse said toner image to said substrate.

In the method of this invention, it is not necessary to incorporate metal-containing fillers in the surface layer of the fusing member and preferred that such metal-containing fillers are absent, nor is it necessary to utilize mercapto-functionalized release oils. Accordingly, the method of this invention provides important benefits in the toner fusing art. Thus, for example, it provides a release surface which minimizes toner offset and which effectively reduces wear of the fusing member, while at the same time avoiding unwanted odor and toxicity problems associated with the methods of the prior art.

DESCRIPTION OF THE PREFERRED EMBODIMENTS

For convenience in description, the invention is hereinafter described with reference to a fuser roll. It is, however, useful with any form of fusing member including, for example, fusing belts as well as fuser rolls.

The fluoroelastomers that are utilized in this fuser roll in accordance with this invention are well-known materials that are commonly used in the manufacture of fuser rolls. See, for example, U.S. Pat. Nos. 4,257,699, 4,264,181 and 4,272,179. Particularly useful fluoroelastomers are polymers of ethylenically unsaturated fluorohydrocarbons. Fluoroelastomers derived from many of these fluorohydrocarbons, including vinylidene fluoride, tetrafluoroethylene, hexafluoropropylene and perfluoroalkylvinyl ethers, are commercially available from a number of suppliers and generally have glass transition temperatures (Tg) in the range of about −40° C. to 10° C. Especially useful fluoroelastomers are vinylidene fluoride-based fluoroelastomers which contain hexafluoropropylene as a comonomer. Two classes of suitable fluoroelastomers are (1) copolymers of vinylidene fluoride and hexafluoropropylene, known commercially as VITON A, and (2) terpolymers of vinylidene fluoride with hexafluoropropylene and tetrafluoroethylene, known commercially as VITON B. VITON A and VITON B are trademarks of E. I. duPont & Co.

The fluoroelastomers can be cured using a basic nucleophile cure system of the type described in U.S. Pat. Nos. 4,257,699, 4,264,181, and 4,272,179 referred to previously herein. Such a cure system generally employs a bifunctional agent such as a bisphenol or a diamine carbamate to generate a covalently crosslinked polymer network formed by the application of heat following basic dehydrofluorination of the polymer. The basic dehydrofluorination reaction requires the presence in the formulation being cured of a basic metal oxide such as magnesium oxide, calcium oxide or lead oxide.

The basic metal oxide reacts with acidic by-products that are believed to include hydrogen fluoride and/or derivatives thereof, that are generated during curing of the fluoroelastomer. The primary reactions involved in the basic nucleophile curing system described in the aforementioned U.S. Patents are also disclosed and discussed in various journals and articles including a paper entitled "VITON Fluoroelastomer Crosslinking by Bisphenols" written by W. W. Schmiegel and presented at the South German Meeting of the Deutsche Katshuk Und Gummi Gesellschaft, Apr. 28–29, 1977. One example of the nucleophilic addition cure system is the bisphenol crosslinking agent with organophosphonium salt accelerator. The phosphonium salt may be exemplified as:

$$\phi_3{}^{+}PCH_2\phi \quad Cl^{\theta}$$

where f represents phenyl groups, and the bisphenol is exemplified as:

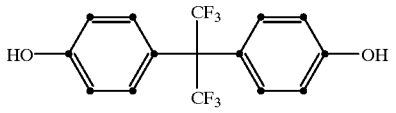

Another example of the nucleophilic addition cure system is crosslinking with a diamine carbamate type curing agent commonly known as DIAK 1. The following scheme showing three separate reactions represents the curing of copoly (vinylidene fluoride-hexafluoro-propylene) with diamine carbamate as the curing or crosslinking agent:

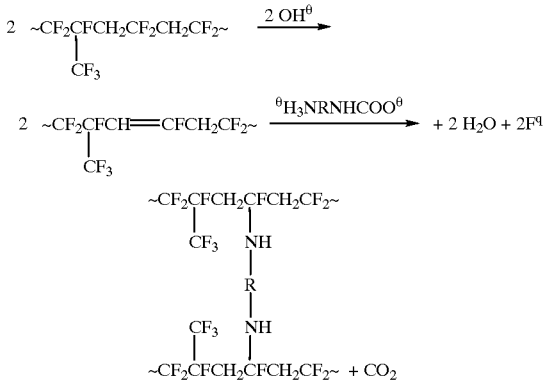

-continued

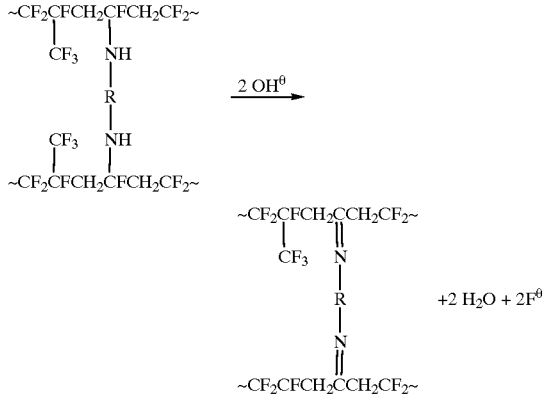

where step 1 shows the loss of HF in the presence of a base; step 2 shows the insertion of the diamine carbamate agent; and step 3 shows post cure in the presence of heat. This mechanism is well known in the art as a crosslinking or curing system. Examples of diamine carbamate cure systems are hexamethylenediarine carbamate known commercially as DIAK No. 1 and N,N'-dicinnamylidene-1,6-hexanediamine known commercially as DIAK No. 3 (DIAK is a trademark of E. I. duPont & Co.)

The cured fluoroelastomer may contain conventional addenda, such as antioxidants, fillers, and stabilizers. The addenda can be blended with the non-cured fluoroelastomer in a concentration of about 5 to 25 weight percent.

The fusing member comprises a support, either a plate, belt or core. The support can comprise any rigid metal or plastic substance, including, for example, aluminum, steel, and various alloys and polymeric materials such as thermoset resins, with or without fiber re-enforcement. The support may have additional underlayers onto which the fluoroelastomer layer is applied. These underlayers can comprise primer. One skilled in the art can select one of the many well-known adhesives or primers available for adhering particular fluoroelastomers to the support. Further, the underlayers may comprise other layers, such as, base cushion layers which are well known for use in fuser rolls, for example, silicone rubbers. Base cushion layers aid in forming a suitable nip for the production of high quality copies.

The fuser roll can be fabricated by first preparing a mixture of the non-cured fluoroelastomer and any addenda. The mixture is blended on compounding rolls to achieve a homogeneous blend. The resulting blend is then dispersed in a suitable solvent such as methylethylketone or methylisobutyl ketone. The composition is then coated on a suitable support, which may or may not comprise underlayers, to form the outer layer of the fuser roll. The coating can be carried out using any convenient technique including ring, dip or spray coating.

The outer layer of the fluoroelastomer is permitted to dry in air to remove volatile solvents and is then subjected to nucleophilic addition curing as described previously herein. The curing treatment is preferably carried out, at least in part, at temperatures of at least 230° C. The curing treatment can be carried out in stages, for example, an initial stage where the temperature of the composition is ramped (gradually raised) from about 20° C. to about 230° C. over a period of about 12 to 24 hours and then cured at that temperature or slightly higher, e.g., 232° C. for about 24 hours.

The critical requirements of the method of this invention are that the fuser roll have a fluoroelastomer surface, that the release oil utilized therewith comprises an Si—H functionalized organopolysiloxane, and that the incubation is carried out at a temperature sufficient to bond a protective layer of the release oil to the fluoroelastomer surface. This combination has been found to provide many advantages, including reduced fuser roll wear, excellent release characteristics and the ability to utilize release oils which are readily available on a commercial basis, non-toxic and odor free.

The Si—H functionalized organopolysiloxanes are well known commercially available materials. For use in this invention, the Si—H functional groups are preferably present at a concentration within the range from 0.1 to 60 mole percent and more preferably within the range from 1 to 10 mole percent. The viscosity of the Si—H functionalized organopolysiloxane can range from 20 to 2,500,000 centistokes at standard temperature and pressure, more preferably 20 to 200,000 centistokes, most preferably from 100 to 60,000 centistokes, and even more preferably from 200 to 2000 centistokes. In carrying out the method of this invention, two or more Si—H functionalized organopolysiloxane fluids can be used in admixture so as to provide particular viscosity and Si—H content to meet the specific demands of the particular fusing system. Non-functionalized silicone fluids can also be blended with the Si—H functionalized organopolysiloxane fluids for the purposes of obtaining balanced physical properties, cost benefits, or both.

Si—H functionalized polyorganosiloxanes of particular utility for use in this invention can be represented by the formula:

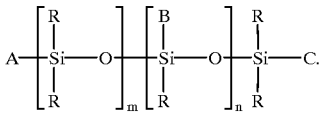

wherein R is alkyl, preferably containing 1 to 10 carbon atoms, cycloalkyl, preferably containing 3 to 10 carbon atoms, alkoxy, preferably containing 1 to 10 carbon atoms, cyanoalkyl, preferably containing 1 to 10 carbon atoms, or phenyl;

A, B and C are hydrogen, alkyl, preferably containing 1 to 10 carbon atoms, or alkoxy, preferably containing 1 to 10 carbon atoms, with the proviso that at least one of A, B or C is hydrogen, m and n are percentages having a value in the range of from 1 to 99 mole percent.

Specific examples of commercially available Si—H functionalized polyorganosiloxane fluids of utility in this invention, all of which are available from PETRARCH SYSTEMS, include:

(1) polymethylhydrosiloxanes such as PS-119, PS-120 and PS-122;

(2) hydride-terminated polydimethylsiloxanes such as PS-542, PS-543 and PS-545; and (3) organo-hydrosiloxane copolymers such as (a) PS-122.5 which is (50–55%) methylhydro-(45–50%)dimethylsiloxane, (b) PS-123 which is (30–35%) methylhydro-(65–70%) dimethylsiloxane, (c) PS-123.5 which is (15–18%) methylhydro-(82–85%)dimethylsiloxane, (d) PS-124.5 which is (3–4%)methylhydro-(96–97%) dimethylsiloxane, (e) PS-123.8 which is (0.5–1.0%)methylhydro-(99.0–99.5%)dimethylsiloxane, (f) PS-124 which is (40–60%)methylhydro-(40–60%) methylcyanopropylsiloxane, (g) PS-125 which is (40–60%)methylhydro-(40–60%) methyloctylsiloxane, (h) PS-125.5 which (25–30%) methylhydro-(70–75%) methyloctylsiloxane, (i) PS-128 which is methyldimethoxy terminated methylhydrosiloxane, and (j) PS-129.5 which is dimethylsiloxy terminated (45–50%)methylhydro-(50–55%)phenylmethylsiloxane.

The affinity of the Si—H functionalized polyorganosiloxane for the fluoroelastomer surface can be increased by incorporating a very small amount of a platinum catalyst in the Si—H functionalized polyorganosiloxane fluid. Amounts of platinum catalyst in the range from $1\times10^{-8}$ to $1\times10^{-4}$ percent based on total weight of the fluid are suitable. Examples of useful platinum catalysts for this purpose include platinum-divinyltetramethyldisiloxane complex available from PETRARCH SYSTEMS as Catalyst PC075 and platinum-cyclovinylmethylsiloxane complex available from PETRARCH SYSTEMS as Catalyst PC085.

As an alternative to incorporating the platinum catalyst in the Si—H functionalized polyorganosiloxane fluid it can be incorporated in the fluoroelastomer. The important requirement is that the incubation step is carried out in the presence of an amount of the catalyst that is sufficient to increase the affinity of the Si—H functionalized polyorganosiloxane for the surface of the fluoroelastomer.

The fusing member is preferably incubated for about 1 to about 60, more preferably 2 to about 55 hours, even more preferably 3 to about 50 hours at a temperature in the range of from about 100° C. to about 250° C., more preferably for about 4 to about 40 hours at a temperature in the range of from about 125° C. to about 200° C., and most preferably for about 8 to about 24 hours at a temperature in the range of from about 160° C. to about 190° C. Generally speaking, the use of shorter incubation periods at higher temperatures gives similar results to the use of longer incubation periods at lower temperatures.

The protective layer of release oil formed by the method of this invention preferably is present over the fluoroelastomer layer at a thickness of 0.5 to 40 nanometers (nm), more preferably 2 to 15 nm, most preferably 5 to 10 nm.

The protective layer of release oil formed by the method of this invention preferably has a percentage atomic Si as determined by X-ray photoelectron spectroscopy of at least 10 percent, more preferably at least 15 percent and most preferably at least 20 percent.

While Applicants do not intend to be bound by any theoretical explanation of the manner in which their invention functions, it has been found that the Si—H functionalized organopolysiloxane exhibits a high degree of affinity towards the fluoroelastomer surface and it is postulated that this occurs as a result of chemical interaction with active sites on such surface with resulting formation of a protective film. The interaction between the Si—H functionalized organopolysiloxane is achieved by the incubation step in the absence of a dehydrohalogenating agent. The protective film provides improved toner release.

The method of this invention is advantageous in permitting the use of a very small amount of the Si—H functionalized polyorganosiloxane fluid as wicking oil, since this fluid very readily wets the surface of the fuser roll. This avoids problems which have been commonly encountered heretofore in which it has been necessary to use so much wicking oil to obtain release of the heat-softenable toner material that the oil stains the paper on which toner is being fused by the fuser roll.

If desired, the method of this invention can include the step of applying to the fusing member a wicking oil after the incubating step and prior to the pressure contacting step and/or after the pressure contacting step. The preferred wicking oil comprises an Si—H functionalized organopolysiloxane. The wicking oil can comprise other additives. One preferred additive is platinum catalyst which is preferably present in the wicking oil from $1\times10^{-8}$ to $1\times10^{-4}$ percent based on total weight of the wicking oil. The wicking oil can be the same composition as the release oil applied to the fusing member and incubated to form the protective layer on the surface of the fusing member. The wicking oil can comprise one or more Si—H functionalized organopolysiloxanes with or without other organopolysiloxanes. It is preferred that the wicking oil has a viscosity of 20 to 200,000 centistokes at standard temperature and pressure. The rate of application of the wicking oil to the fuser roll of this invention is from 1 to 10 mg/copy, more preferably 2 mg/copy.

The method of this invention is useful for fusing heat-softenable toner materials of all types having the physical properties required in dry electrostatographic toner materials. Such toner materials or particles can be thermally fixed or adhered to a receiving sheet such as paper or plastic. These thermal fixing techniques are well known in the art.

Many polymers have been reported in the literature as being useful in dry electrostatographic toners. Polymers useful in such toners include vinyl polymers, such as homopolymers and copolymers of styrene and condensation polymers such as polyesters and copolyesters. Fusible styrene-acrylic copolymers which are covalently lightly crosslinked with a divinyl compound such as divinylbenzene, as disclosed in the patent to Jadwin et al, U.S. Pat. No. Re 31,072, are useful. Also useful are polyesters of aromatic dicarboxylic acids with one or more aliphatic diols, such as polyesters of isophthalic or terephthalic acid with diols such as ethylene glycol, cyclohexane dimethanol and bisphenols. Examples are disclosed in the patent to Jadwin et al.

Fusible toner particles used in this invention can have fusing temperatures in the range from about 50° C. to 200° C. so they can readily be fused to paper receiving sheets. Preferred toners fuse in the range of from about 65° C. to 120° C. If the toner transfer is made to receiving sheets which can withstand higher temperatures, polymers of higher fusing temperatures can be used.

Useful toner particles can simply comprise the polymeric particles but, it is often desirable to incorporate addenda in the toner such as waxes, colorants, release agents, charge control agents, and other toner addenda well known in the art.

If a colorless image is desired, it is not necessary to add colorant to the toner particles. However, more usually a visibly colored image is desired and suitable colorants selected from a wide variety of dyes and pigments such as disclosed, for example, in U.S. Reissue Pat. No. 31,072 are used. A particularly useful colorant for toners to be used in black-and-white electrophotographic copying machines is carbon black. Colorants in the amount of about 1 to about 30 percent, by weight, based on the weight of the toner can be used. Often about 1 to 8 percent, by weight, of colorant is employed.

Charge control agents suitable for use in toners are disclosed for example in U.S. Pat. Nos. 3,893,935; 4,079,014; and 4,323,634 and in British Patent Nos. 1,501,065 and 1,420,839. Charge control agents are generally employed in small quantities such as, about 0.1 to about 3 weight percent, often 0.2 to 1.5 weight percent, based on the weight of the toner.

Toners used in the method of this invention can be mixed with a carrier vehicle. The carrier vehicles, which can be used to form suitable developer compositions, can be selected from a variety of materials. Such materials include carrier core particles and core particles overcoated with a thin layer of film-forming resin. Examples of suitable resins are described in U.S. Pat. Nos. 3,547,822; 3,632,512; 3,795,618; 3,898,170; 4,545,060; 4,478,925; 4,076,857; and 3,970,571.

The carrier core particles can comprise conductive, non-conductive, magnetic, or non-magnetic materials. See, for example, U.S. Pat. Nos. 3,850,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites such as ferrites of barium, strontium, lead, magnesium, or aluminum. See, for example, U.S. Pat. Nos. 4,042,518; 4,478,925; and 4,546,060.

A typical developer composition containing toner particles and carrier vehicle generally comprises about 1 to 20 percent, by weight, of particulate toner particles and from 60 to 99 percent, by weight, carrier particles. Usually, the carrier particles are larger than the toner particles. Conventional carrier particles have a particle size on the order of about 20 to 1200 micrometers, generally about 30 to 300 micrometers. Alternatively, the toners can be used in a single component developer, i.e., with no carrier particles.

Typical toner particles generally have an average diameter in the range of about 0.1 to 100 mm, a value of about 2 to 20 mm being particularly useful in many current copy machines.

The invention is further illustrated by the following examples.

EXAMPLES 1–19

In order to evaluate the relative affinity of polyorganosiloxanes for fluoroelastomer surfaces, a fluoroelastomeric composition comprising VITON A copolymer was prepared as described below. Quantitative measurement of the attachment of the polyorganosiloxane to the surface of the fluoroelastomeric composition was carried out by X-ray photoelectron spectroscopy after the composition was incubated for 8 hours at 170° C. in contact with the polyorganosiloxane fluid and then subjected to repeated washings with dichloromethane to remove unreacted fluid.

One hundred parts of VITON A copolymer (copolyhexafluoropropylene-vinylidene fluoride) having a number average molecular weight of 100,000 (available from E. I. duPont & Co.), 20 parts of lead monoxide, 20 parts of carbon black (STAINLESS THERMAX N 990 from R. T. Vanderbilt Co.), 6 parts of the cross-linking agent hexafluoroisopropylidenediphenol, and 2.5 parts of the cure accelerator triphenylbenzylphosphonium chloride were thoroughly compounded on a two-roll mill until a uniform and smooth sheet was obtained. Part of the sheet was cut into small pieces and dissolved in methyl ethyl ketone to form a 20% coating dispersion. The dispersion was hand-coated on 2-mil stainless steel shim, air dried for 24 hours, ramped to 232° C. over a 24-hour period and cured at 232° C. for 24 hours.

The coated stainless steel was cut into small pieces and a drop of polyorganosiloxane fluid was applied to each piece and uniformly spread over the surface thereof. After incubation at 170° C. for 8 hours and washing with dichloromethane, the values for atomic percent silicon and atomic percent fluorine were determined by X-ray photoelectron spectroscopy.

The results obtained are reported in Table I below which also describes the polyorganosiloxane fluid or mixture of fluids used and the amount of platinum catalyst incorporated in the polyorganosiloxane fluid.

TABLE I

| Example No. | Polyorganosiloxane Fluid | Catalyst* (% by weight) | % Si | % F |
|---|---|---|---|---|
| Control 1 | None | 0 | 2.7 | 40.2 |
| Control 2 | Silicone Fluid DC-200** | 0 | 8.1 | 27.1 |
| Control 3 | Silicone Fluid F655B*** | 0 | 20.8 | 5.5 |
| 1 | PS-542 | 0 | 11.9 | 19.5 |
| 2 | PS-123.8 | 0 | 24.4 | 2.2 |
| 3 | PS-124.5 | 0 | 13.7 | 17.2 |
| 4 | PS-123.8 | $1.2 \times 10^{-6}$ | 24.9 | 1.6 |
| 5 | PS-123.8 | $6.0 \times 10^{-7}$ | 24.3 | 2.4 |
| 6 | PS-123.8 | $1.2 \times 10^{-7}$ | 24.0 | 3.1 |
| 7 | PS-124.5 | $1.2 \times 10^{-6}$ | 16.1 | 13.5 |
| 8 | PS-124.5 | $6.0 \times 10^{-7}$ | 13.3 | 17.9 |
| 9 | PS-124.5 | $1.2 \times 10^{-7}$ | 13.4 | 17.1 |
| 10 | PS-124.5 | 0 | 15.7 | 13.8 |
| 11 | PS-123.8/PS-124.5 (5/95) | 0 | 17.2 | 11.5 |
| 12 | PS-123.8/PS-124.5 (10/90) | 0 | 17.1 | 11.8 |
| 13 | PS-123.8/PS-124.5 (15/85) | 0 | 16.6 | 11.9 |
| 14 | PS-123.8/PS-124.5 (20/80) | 0 | 15.7 | 13.6 |
| 15 | PS-123.8/PS-124.5 (25/75) | 0 | 19.5 | 8.3 |
| 16 | PS-123.8/PS-124.5 (30/70) | 0 | 18.0 | 11.3 |
| 17 | PS-123.8/PS-124.5 (35/65) | 0 | 19.5 | 8.5 |
| 18 | PS-123.8/PS-124.5 (40/60) | 0 | 20.3 | 8.5 |
| 19 | PS-123.8/PS-124.5 (50/50) | 0 | 24.0 | 8.2 |

*The catalyst was PC075, a platinum catalyst available from PETRARCH SYSTEMS

**Silicone Fluid DC-200 is a non-functionalized trimethylsiloxane-terminated polydimethylsiloxane fluid available from DOW-CORNING CHEMICAL CO.

***Silicone Fluid F-655B is a mercapto-functionalized polydimethylsiloxane (0.089%-SH by weight) available from STAUFFER-WACKER SILICONE CORP.

In a test designated herein as Control 4, the procedure of Control 3 was repeated except that incubation was for 8 hours at room temperature rather than 8 hours at 170° C. The % Si was 7.2 and the % F was 26.3. In a test designated herein as Control 5, the procedure of Example 19 was repeated except that incubation was for 8 hours at room temperature rather than 8 hours at 170° C. The % Si was 2.5 and the % F was 39.1. These results indicate that the incubation must be carried out at an elevated temperature in order to get effective coverage of the release oil. As hereinabove described, the minimum effective temperature for incubation is about 100° C.

For a surface totally covered with polydimethylsiloxane, the calculated % atomic Si is 25%. As shown by the data in Table I, use of the non-functionalized polyorganosiloxane DC-200 provided a % atomic Si of only 8.1. Use of the Si—H functionalized polyorganosiloxanes in Examples 1 to 19 provided a % atomic Si ranging from 11.9 to 24.4. In comparison, the mercapto-functionalized polyorganosiloxane F-655B provided a % atomic Si value of 20.8 but suffers from the disadvantages of unpleasant odor and toxicity hereinbefore described. Thus, results as good or better than those obtained with the mercapto-functionalized polyorganosiloxane can be obtained by use of Si—H functionalized polyorganosiloxanes in accordance with this invention. As also shown by the data in Table I, use of a platinum catalyst can result in a slight improvement in the degree of affinity exhibited.

The use of a platinum catalyst is especially beneficial with lower molecular weight Si—H functionalized organopolysiloxanes. Thus, comparing Examples 4, 5 and 6 in Table I shows little improvement in % Si resulting from use of the catalyst with the PS-123.8 fluid which has a molecular weight of 63,000. On the other hand, comparing Examples 7, 8 and 9 in Table I shows significant improvement in % Si (16.1% as compared to 13.3%) when a sufficient amount of the catalyst was used with PS-124.5 fluid which has a molecular weight of 13,000.

The high affinity of Si—H functionalized organopolysiloxanes towards fluoroelastomers provides a surface with excellent release characteristics for toner images. Use of this surface in a fusing process provides a highly effective way of meeting the need for excellent release characteristics without excessive wear of the fuser roll and without encountering the problems of odor and toxicity associated with prior use of mercapto-functional polydiorganosiloxanes.

The invention has been described in detail with particular reference to preferred embodiments thereof, but it will be understood that variations and modifications can be effected within the spirit and scope of the invention.

We claim:

1. A method of fusing a toner image to a substrate, which method comprises:

applying a release oil to the surface of a fusing member, said surface of said fusing member comprising a fluoroelastomer, and said release oil comprising an organopolysiloxane having Si—H functional groups, incubating said fusing member at 100° C. to 250° C. in the absence of a dehydrohalogenating agent to bond a protective layer of said release oil to said surface of said fusing member, said protective layer having a thickness of 0.5 to 40 nanometers, and pressure contacting a toner image carried on a substrate with said fusing member at a temperature effective to fuse said toner image to said substrate.

2. The method as claimed in claim 1 wherein said fluoroelastomer is a polymer of an ethylenically unsaturated fluorohydrocarbon.

3. The method as claimed in claim 1 wherein said fluoroelastomer is a copolymer of vinylidene fluoride and hexafluoropropylene.

4. The method as claimed in claim 1 wherein said fluoroelastomer is a terpolymer of vinylidene fluoride, hexafluoropropylene and tetrafluoroethylene.

5. The method as claimed in claim 1 wherein said organopolysiloxane contains Si—H functional groups at a concentration within the range from 0.1 to 60 mole percent.

6. The method as claimed in claim 1 wherein said organopolysiloxane contains Si—H functional groups at a concentration within the range from 1 to 10 mole percent.

7. The method as claimed in claim 1 wherein said organopolysiloxane has a viscosity of from 20 to 2,500,000 centistokes at standard temperatures and pressure.

8. The method as claimed in claim 1 wherein said release oil additionally contains a platinum catalyst which increases the affinity of said Si—H functionalized polyorganosiloxane for the surface of said fluoroelastomer.

9. The method as claimed in claim 1 wherein said Si—H functionalized organopolysiloxane has the formula:

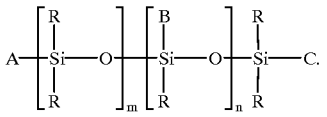

wherein R is alkyl, cycloalkyl, alkoxy, cyanoalkyl or phenyl,

A, B and C are hydrogen, alkyl or alkoxy with the proviso that at least one of A, B or C is hydrogen, and m and n are mole percentages having a value in the range of from 1 to 99 percent.

10. The method as claimed in claim 1 wherein said Si—H functionalized organopolysiloxane is a polymethylhydrosiloxane.

11. The method as claimed in claim 1 wherein said Si—H functionalized organopolysiloxane is a hydride-terminated polydimethylsiloxane.

12. The method as claimed in claim 1 wherein said Si—H functionalized organopolysiloxane is an organohydrosiloxane copolymer.

13. A method as claimed in claim 1, wherein said Si—H functionalized organopolysiloxane is an admixture of at least two Si—H functionalized organopolysiloxane fluids.

14. A method as claimed in claim 1, wherein said release oil additionally contains a non-functionalized silicone fluid.

15. A method as claimed in claim 1, wherein said fusing member is incubated for 1 to 60 hours.

16. A method as claimed in claim 1, wherein said fusing member coated with the release oil is incubated for 8 hours at 170° C. to provide an atomic percentage of Si at the surface of said fusing member in the range from 11.9 to 24.4 percent.

17. A method as claimed in claim 1, wherein said fusing member is incubated for about 2 to about 55 hours at a temperature in the range of from 100° C. to 250° C.

18. A method as claimed in claim 1, wherein said fusing member is incubated for about 4 to about 40 hours at a temperature in the range of from about 125° C. to about 200° C.

19. A method of fusing a toner image to a substrate, which method comprises:

applying a release oil to the surface of a fusing member, said surface of said fusing member is comprised of a fluoroelastomer, and said release oil comprises an Si—H functionalized organopolysiloxane having Si—H functional groups, incubating said fusing member at 100° C. to 250° C. in the absence of a dehydrohalogenating agent to bond a protective layer of said release oil to said surface of said fusing member, said protective layer having a thickness of 0.5 to 40 nanometers, applying wicking oil to said fusing member; said wicking oil comprises Si—H functionalized organopolysiloxane, and pressure contacting a toner image carried on a substrate with said fusing member at a temperature effective to fuse said toner image to said substrate.

20. A method as claimed in claim 19, wherein said wicking oil further comprises platinum catalyst.

* * * * *